United States Patent [19]

Matsunaga et al.

[11] 4,161,431

[45] Jul. 17, 1979

[54] PROCESS FOR PRODUCING THIN FILM RESISTOR

[75] Inventors: Takehiko Matsunaga; Saburo Umeda, both of Yokohama; Tsuneaki Kamei, Tokyo, all of Japan

[73] Assignee: Hitachi, Ltd., Japan

[21] Appl. No.: 860,618

[22] Filed: Dec. 14, 1977

[30] Foreign Application Priority Data

Dec. 17, 1976 [JP] Japan ..... 51-150951

[51] Int. Cl.[2] ..... C25D 5/02; C25D 11/02; H01C 17/06

[52] U.S. Cl. ..... 204/15; 29/620; 29/625; 204/37 R; 204/38 A; 427/101

[58] Field of Search ..... 204/15, 38 A, 37 R, 204/192 R, 192 C; 29/620, 625; 427/101-103, 124, 126

[56] References Cited

U.S. PATENT DOCUMENTS

| | | | |
|---|---|---|---|
| 3,387,952 | 6/1968 | La Chapelle | 204/15 |
| 3,423,260 | 1/1969 | Heath et al. | 29/620 |
| 3,489,656 | 1/1970 | Balde | 204/15 |
| 3,544,287 | 1/1970 | Sharp | 204/37 R |
| 3,607,679 | 9/1971 | Melroy | 204/38 A |
| 3,786,557 | 1/1974 | Bodway | 204/15 |

*Primary Examiner*—T. M. Tufariello
*Attorney, Agent, or Firm*—Craig and Antonelli

[57] ABSTRACT

A thin film resistor is produced by forming a film of tantalum pentoxide on part of a pattern of tantalum nitride, simultaneously forming an electroconductor and an electrode on other part, where no film of tantalum pentoxide is formed, by means of a metal cheaper than gold, and heating the pattern in an inert gas atmosphere.

10 Claims, 13 Drawing Figures

PROCESS FOR PRODUCING THIN FILM RESISTOR

LIST OF PRIOR ART REFERENCE (37 CFR 1.56 (a))

The following reference is cited to show the state of art.

I. Miyata et al.: "Reliability of solder melt joint", papers 112 disclosed in General Conference of Denshi Tsushin Gakkai (the Institute of Electronic Communication Engineers of Japan), Vol. 1, March, 1976.

BACKGROUND OF THE INVENTION

1. FIELD OF THE INVENTION

This invention relates to a process for producing a thin film resistor.

2. DESCRIPTION OF THE PRIOR ART

Heretofore, thin film resistors have been produced as shown the accompanying drawings FIG. 1(*a*) to FIG. 1(*e*). That is, a non-alkaline glass film 2 is formed on an alumina substrate 1 as shown in FIG. 1(*a*). Then, a tantalum film is formed on the non-alkaline glass film 2, and then said tantalum film is oxidized to form a tantalum pentoxide film 3. The tantalum pentoxide film is provided to protect the non-alkaline glass film by successive etching from attacking. A tantalum nitride film 4 is formed on the tantalum pentoxide film 3.

Successively, part of the tantalum nitride film 4 is removed by photoetching to form a pattern 4', as shown in FIG. 1(*b*). Only portion of the pattern 4', which is desired to be a resistor, is anodically oxidized to obtain an anodically oxidized tantalum pentoxide film 5.

Then, a Nichrome film 6*a* is formed on other part of pattern 4', where no tantalum pentoxide film 5 is provided, a gold film 6*b* on the film 6*a*, and a Nichrome film 6*c* on the film 6*b*, each by vapor deposition and photo-etching, to make a conductor 6, as shown in FIG. 1(*c*). In that case, the Nichrome film 6*a* serves to bond the tantalum nitride at the part of pattern 4' and the gold film 6*b* of good electroconductivity to each other, and the Nichrome film 6*c* serves to prevent diffusion of solder down to the gold film 6*b* when soldering is applied to solder bumps to be later formed. Of course, the Nichrome film 6*c* has a good adhesiveness to the gold film 6*b*, but a poor solder wettingness. Electrode on which solder bumps are to be formed, must be thus provided with a metal of good solder wettingness additionally.

Therefore, as shown in FIG. 1(*d*), a chromium film 7*a* is formed on part of the Nichrome film 6*c* of conductor 6, a rhodium film 7*b* on the film 7*a*, and a gold film 7*c* on the film 7*b*, each by masking vapor deposition, to form an electrode 7. In that case, the chromium film 7*a* serves to bond the rhodium film 7*b* to the Nichrome film 6*c*, and the gold film 7*c* serves to form solder bumps. Of course, the gold film 7*c* has a good adhesiveness to the rhodium film 7*b*. Then, the part of such a structure as shown in FIG. 1(*d*) is heated in the air to oxidize and stabilize the tantalum nitride film below on the anodically oxidized tantalum pentoxide film 5.

Finally, solder bumps 8 are formed on the metal film 7*c* as the uppermost layer of the electrode 7, as shown in FIG. 1(*e*), thereby producing a film resistor.

However, said process for producing the thin film resistor has the following drawbacks:

(1) The electrode is formed after the formation of the conductor, and thus the conductor and the electrode cannot be formed at the same time.

(2) Oxidation and stabilization of the tantalum nitride film are carried out in an oxidizing atmosphere, and thus a non-oxidizable, expensive gold must be used at the conductor and electrode.

SUMMARY OF THE INVENTION

An object of the present invention is to form the conductor and the electrode at the same time.

Another object of the present invention is to form the conductor and the electrode with a metal cheaper than gold.

As a result of various studies on a process for producing a thin film resistor to attain said objects, the present inventors have found that a conductor and an electrode are formed apart from each other with a metal cheaper than gold at the same time on other parts of pattern than the part destined to a resistor, the pattern is heated in an inert gas to stabilize the part destined to the resistor and increase the adhesiveness of each film, and then solder bumps are formed on the electrode.

In the present invention, a thin film resistor can be produced by a simplified process, that is, the present process being by one step less than the conventional process, and a metal cheaper than gold can be used on the conductor and the electrode. That is, film resistor can be produced at a lower cost.

Materials and procedure employed in the present invention are as follows:

Metals for the conductor and the electrode are a metal selected from chromiuum, titanium and Nichrome for the first layer, and nickel for the second layer.

Pattern (parts destined to the conductor, electrode and resistor) can be formed directly on an alumina substrate, but it is preferable to form a non-alkaline glass film on the alumina substrate, a tantalum film on the non-alkaline glass film, and the pattern on the tantalum film.

Films and pattern are formed as follows:

In the formation of the non-alkaline glass film on the alumina substrate, a printing or spray coating method followed by baking is preferable. Thickness of the film is 10–100$\mu$, preferably 20–50$\mu$, to make the irregularity on the alumina substrate surface even.

In the formation of the tantalum film on the non-alkaline glass film, a sputtering method is preferable. Diode sputtering method ($2\text{–}3\times10^{-2}$ Torr, 4.5–6.5 kV under an argon gas atmosphere), plasma sputtering method ($1\text{–}5\times10^{-2}$ Torr, 4.5–6.5 kV under an argon gas atmosphere), planer magnetron sputtering method ($1\text{–}5\times10^{-3}$ Torr, 0.7–2 kV under an argon gas atmosphere) etc. can be employed as the sputtering method. Thickness of the tantalum film formed is 400–600 Å, preferably 500 Å. The oxidation of the tantalum film (formation of the tantalum pentoxide film) can be carried out by heating at 500°–600° C. for 4–10 hours under an oxygen atmosphere, preferably at 550° C. for 5 hours under an oxygen atmosphere.

In the formation of tantalum nitride on the tantalum pentoxide film, a similar sputtering method to the above is employed under an atmosphere of argon gas and nitrogen gas. Thickness of the tantalum nitride is 300–1200 Å.

The part destined to the resistor on the pattern of tantalum nitride film is formed into an anodically oxidized tantalum pentoxide film by anodic oxidation. Anodic oxidation is carried out in an aqueous 0.01–0.5% citric acid solution under an applied voltage of 40–50 V, preferably in an aqueous 0.01% citric acid solution under an applied voltage of 45 V. Tantalum nitride area resistance below on the anodically oxidized tantalum pentoxide film is 50Ω/□–150Ω/□, preferably 100Ω/□.

Heat treatment of the resistor below on the anodically oxidized tantalum pentoxide film is carried out by heating at 250° to 400° C. for 0.5 to 5 hours in a nitrogen gas atmosphere, or an argon gas atmosphere, or a nitrogen gas-argon gas atmosphere, or under vacuum. Heating temperature and heating time are preferably 300° C. and 2 hours, respectively.

DESCRIPTION OF THE PREFERRED EMBODIMENTS

The present invention will be described in detail, referring to Examples and the accompanying drawings.

Example 1

Figure 1A:
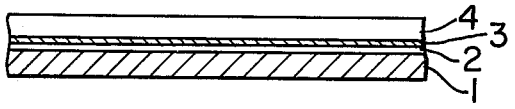
FIG. 1(*a*) to FIG. 1(*e*) are cross-sectional views showing steps of producing a thin film resistor according to the conventional process.
Figure 1B:
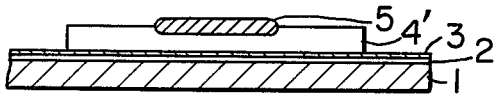
Figure 1C:
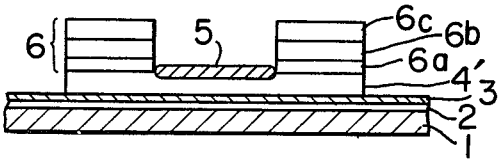
Figure 1D:
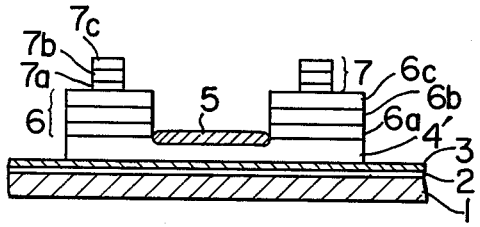
Figure 1E:
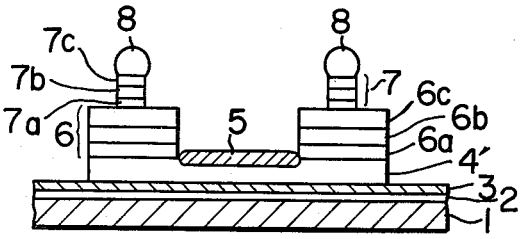
Figure 2A:
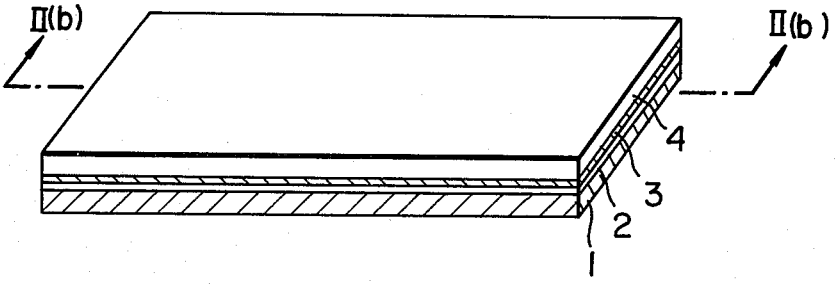
FIG. 2(*a*) to FIG. 5(*a*) are schematical views showing steps of producing a thin film resistor according to the present invention, and FIG. 2(*b*) to FIG. 5(*b*) are cross-sectional views along lines II(*b*)–II(*b*), III(*b*)–III(*b*), IV(*b*)–IV(*b*), and V(*b*)–V(*b*) in FIG. 2(*a*) to FIG. 5(*a*), respectively.
Figure 2B:
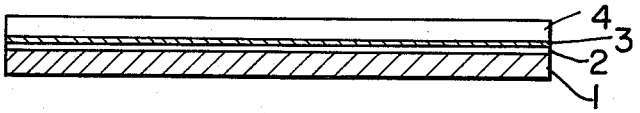

As shown in FIG. 2(*a*) and FIG. 2(*b*), a paste consisting of non-alkaline glass powders comprising $SiO_2$, PbO, $Bi_2O_3$, $B_2O_3$, $Al_2O_3$, etc. and an organic vehicle is screen printed onto an alumina substrate 1, and heated to 900° C., and then cooled to form a non-alkaline glass film 2. Then, a tantalum film (film thickness: 500 Å) is formed on the non-alkaline glass film 2. Formation of the tantalum film is carried out by a diode sputtering method at an applied voltage of 5.2 kV and a current density of 0.1 mA/cm$^2$ under an argon atmosphere of $10^{-2}$ Torr. The resulting tantalum film is heated at 500° C. for 5 hours under an oxygen atmosphere to obtain a tantalum pentoxide film 3.

A tantalum nitride film 4 (film thickness: 1,000 Å) is formed on the tantalum pentoxide film 3 by a diode sputtering method at an applied voltage of 5.2 kV and a current density of 0.3 mA/cm$^2$ under an argon-nitrogen gas atmosphere of $10^{-2}$ Torr.

Figure 3A:
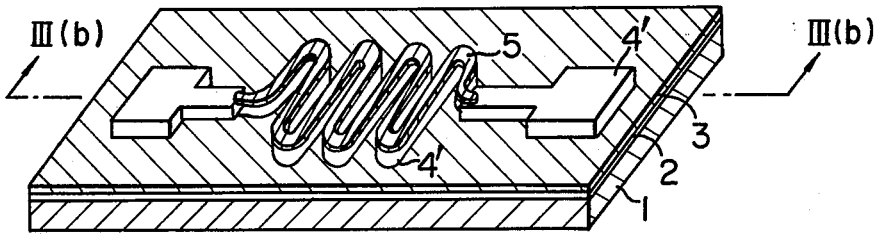
Figure 3B:
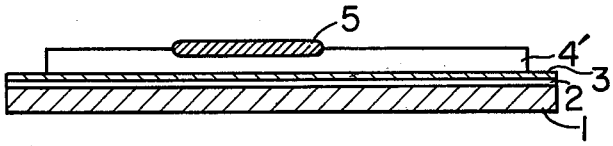

Then, as shown in FIG. 3(*a*) and FIG. 3(*b*), part of the tantalum nitride film 4 is removed by photo-etching to form a pattern part 4', and part destined to resistor on the pattern is anodically oxidized to form an anodically oxidized tantalum pentoxide film 5. Anodic oxidation is carried out in an aqueous 0.1% citric acid solution at an applied voltage of 45 V.

Figure 4A:
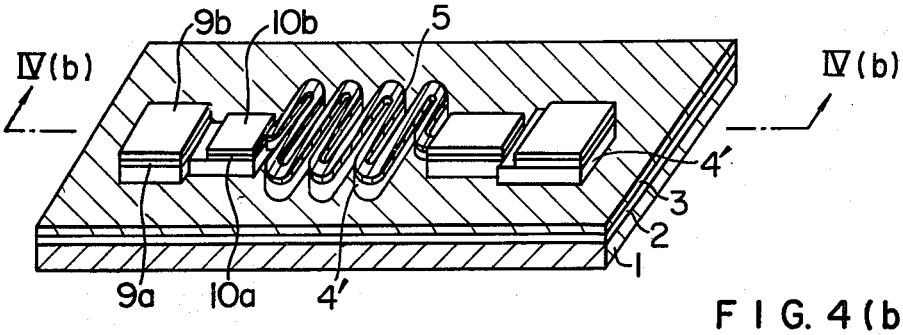
Figure 4B:
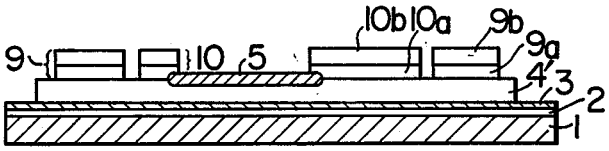

Then, as shown in FIG. 4(*a*) and FIG. 4(*b*), a conductor 10 and an electrode 9 are formed apart from each other at the same time on other part of the pattern part 4' where no tantalum pentoxide film 5 is formed. That is, a mask having a desired pattern is placed on the pattern part 4' and the anodically oxidized tantalum pentoxide film 5, then chromium films 9*a* and 10*a* are formed thereon by a vacuum vapor deposition method, and nickel films 9*b* and 10*b* are further formed thereon to make the conductor 10 and the electrode 9, respectively. Thickness of the chromium films is 500 Å, and that of the nickel film 5,000 Å.

Then, the article in the state of FIG. 4(*a*) and FIG. 4(*b*) are heated at 300° C. for 2 hours under a nitrogen atmosphere. The heat treatment has the following actions:

(1) to increase an adhesiveness between the chromium films 9*a* and 9*b*, and the pattern part 4' of the tantalum nitride film.

(2) to increase an adhesiveness between the chromium films 9*a* and 9*b*, and the nickel films 10*a* and 10*b*.

(3) to diffuse oxygen from the anodically oxidized tantalum pentoxide film into the pattern part 4' of the tantalum nitride film below on the anodically oxidized tantalum pentoxide film, thereby stabilizing and adjusting a resistance of the resistor.

(4) to remove and stabilize stresses on all the films thus formed.

Figure 5A:
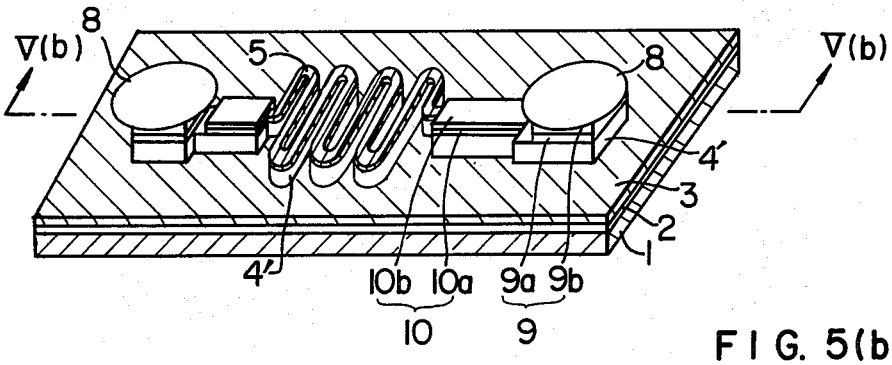
Figure 5B:
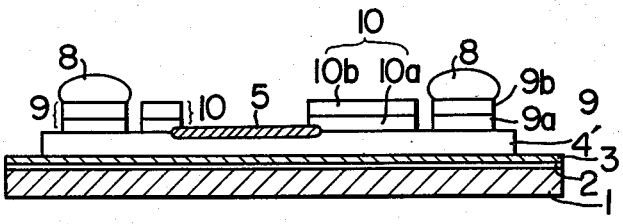

Finally, as shown in FIG. 5(*a*) and 5(*b*), solder bumps 8 are formed on the nickel film 9*b* on the electrode 9 to form a thin film resistor.

In the present embodiment, the pattern part, on which the tantalum pentoxide film is formed, that is, the resistor part, is made to be small in width and large in length, so that the desired resistance can be almost set on this part. The pattern part 4' on which the conductor is formed is made larger in width than said resistor part, and the pattern part on which the electrode is formed is larger in width than the pattern part on which the conductor is formed, so that an overall volumic resistance of the pattern part can be made smaller on these conductor and electrode than said resistor part. Said desired resistance can be substantially given by sum total of the resistance of said resistor part, resistances of the conductors connected in series to the resistor part, and resistances of slit parts between the respective conductors and the respective electrodes, that is, volumic resistances of the pattern part on which nothing is formed.

EXAMPLE 2

A tantalum nitride film (film thickness: 2,000 Å) is formed directly on the alumina substrate of FIG. 2(*a*) and FIG. 2(*b*) by a diode sputtering method, and a film resistor is then prepared from it in the same manner as in Example 1.

What is claimed is:

1. A process for producing a thin film resistor, which comprises a first step of forming a tantalum nitride film on an alumina substrate by sputtering, a second step of removing part of the tantalum nitride film formed in the first step by photo etching, thereby forming a pattern, and anodically oxidizing part of the pattern destined to be the resistor, thereby forming a tantalum pentoxide film, a third step of forming a first electrode layer of one metal selected from chromium, titanium, and Nichrome by vacuum vapor deposition on the pattern, so that the tantalum pentoxide formed in the second step is directly connected to a conductor part and the electrode layer is apart from the conductor part, and forming a nickel film as a second electrode layer on the first electrode layer likewise by vacuum vapor deposition, whereby an electrode part is formed apart from said conductor part, a fourth step of heat treating the article obtained in the third step in an atmosphere of a gas selected from argon gas, nitrogen gas and argon-nitrogen gas mixture, and a fifth step of forming a solder bump at the electrode part treated in the fourth step.

2. A process according to claim 1, wherein, in said third step, a first conductor layer is formed simultaneously with said first electrode layer by vacuum vapor deposition, said first conductor layer being formed of a metal selected from the group consisting of chromium, titanium and Nichrome, and a second conductor layer is formed simultaneously with the second electrode layer by vacuum vapor deposition, said second conductor layer being formed on said first conductor layer and of nickel, whereby said conductor part is formed.

3. A process according to claim 2, wherein said first conductor layer and said first electrode layer are made from the same material, and said second conductor layer and second electrode layer are made from the same material.

4. A process according to claim 3, wherein the conductor part and the electrode part are formed on a part of the pattern not having a tantalum pentoxide film formed thereon.

5. A process according to claim 4, wherein said fourth step of heat treating the article is carried out by heating at a temperature of 250°–400° C. for 0.5–5 hours.

6. A process for producing a thin film resistor, which comprises a first step of forming a non-alkaline glass film on an alumina substrate, a second step of forming a tantalum film on the non-alkaline glass film formed in the first step and then oxidizing the tantalum film, thereby forming a tantalum pentoxide film, a third step of forming a tantalum nitride film on said tantalum pentoxide film by sputtering, a fourth step of removing part of the tantalum nitride film formed in said third step by photo etching, thereby forming a pattern, and anodically oxidizing part of the pattern destined to be the resistor, thereby forming a tantalum pentoxide film, a fifth step of forming a first electrode layer of one metal selected from chromium, titanium, and Nichrome by vacuum vapor deposition on the pattern, so that the tantalum pentoxide formed in the fourth step is directly connected to a conductor part and the electrode layer is apart from the conductor part, and forming a nickel film as a second electrode layer on the first electrode layer likewise by vacuum vapor deposition, whereby an electrode part is formed apart from said conductor part, a sixth step of heat treating the article obtained in the fifth step in an atmosphere of a gas selected from argon gas, nitrogen gas and argon-nitrogen gas mixture, and a seventh step of forming a solder bump at the electrode part treated in the sixth step.

7. A process according to claim 6, wherein, in said fifth step, a first conductor layer is formed simultaneously with said first electrode layer by vacuum vapor deposition, and said first conductor layer being formed of a metal selected from the group consisting of chromium, titanium and Nichrome, and a second conductor layer is formed simultaneously with the second electrode layer by vacuum vapor deposition, said second conductor layer being formed on said first conductor layer and of nickel, whereby said conductor part is formed.

8. A process according to claim 7, wherein said first conductor layer and said first electrode layer are made from the same material, and said second conductor layer and second electrode layer are made from the same material.

9. A process according to claim 8, wherein the conductor part and the electrode part are formed on a part of the pattern not having a tantalum pentoxide film formed thereon.

10. A process according to claim 9, wherein said sixth step of heat treating the article is carried out by heating at a temperature of 250°–400° C. for 0.5–5 hours.

* * * * *